US006164583A

United States Patent [19]

Spatafora

[11] Patent Number: 6,164,583

[45] Date of Patent: Dec. 26, 2000

[54] METHOD AND A UNIT FOR FEEDING A STRIP OF SHEET MATERIAL

[75] Inventor: Mario Spatafora, Bologna, Italy

[73] Assignee: G.D S.p.A., Bologna, Italy

[21] Appl. No.: 09/286,423

[22] Filed: Apr. 6, 1999

[30] Foreign Application Priority Data

Apr. 8, 1998 [IT] Italy ..... BO98A0232

[51] Int. Cl.[7] ..... B65B 19/00

[52] U.S. Cl. ..... 242/420.6; 242/331.3; 242/331.4; 242/418.1

[58] Field of Search ..... 242/331.3, 331.4, 242/418.1, 420.6, 417.1, 413.6; 226/42, 118.1

[56] References Cited

U.S. PATENT DOCUMENTS

| | | | |
|---|---|---|---|
| 2,907,565 | 10/1959 | Sauter . | |
| 3,796,393 | 3/1974 | Beistle | 242/331.3 |
| 4,011,976 | 3/1977 | Greer | 226/42 |
| 4,065,074 | 12/1977 | Anderson et al. | 242/331.3 |
| 4,384,665 | 5/1983 | Waddington . | |
| 4,437,619 | 3/1984 | Cary et al. | 242/420.6 |
| 4,509,007 | 4/1985 | Barsotti et al. | 242/331.3 |
| 4,762,292 | 8/1988 | D'Anci | 242/331.4 |
| 5,308,005 | 5/1994 | Hutteman et al. . | |
| 5,992,789 | 11/1999 | Lamothe | 242/418.1 |

FOREIGN PATENT DOCUMENTS

| | | |
|---|---|---|
| 822 155 | 2/1998 | European Pat. Off. . |
| 1 499 001 | 8/1969 | Germany . |
| 1 469 683 | 4/1977 | United Kingdom . |
| 2 249 782 | 5/1992 | United Kingdom . |

*Primary Examiner*—Katherine A. Matecki
*Attorney, Agent, or Firm*—Pillsbury Madison & Sutro LLP

[57] ABSTRACT

A strip of sheet wrapping material fed to a user device is decoiled from a roll at an upstream station and then drawn by a vacuum into an equalizing chamber, internally of which it forms a running loop. The length of the loop is measured continuously by an analog sensing device operating in conjunction with at least one bistable pressure sensor, located at a given height inside the chamber, so as to establish a range of variation outside of which the measurement is ignored; thus, the length of the loop can be monitored accurately by the analog sensor within the selected range of variation, and maintained within this same range by the action of the pressure sensor.

12 Claims, 2 Drawing Sheets

METHOD AND A UNIT FOR FEEDING A STRIP OF SHEET MATERIAL

BACKGROUND OF THE INVENTION

The present invention relates to a method of feeding a strip of sheet material.

In particular, the invention relates to a method of feeding a continuous strip of sheet material to a user machine, for example an automatic cigarette manufacturing or packaging machine.

In conventional units for feeding strip material to a user machine, the strip is generally drawn from a roll located at a decoiling station and transferred to a device of the user machine by way of a vacuum equalizing chamber.

The equalizing chamber consists essentially of an enclosure equipped with vacuum means designed to generate a constant force by which the strip of material is attracted and caused to form a loop of variable length within the enclosure. Thus, the tension on the strip is maintained steady and equal to the vacuum force for the duration of its passage through the feed unit.

The rate at which the strip comes off the roll at the decoiling station is regulated according to the length of the loop formed by the strip inside the equalizing chamber; for example, an increase in length signifies that the strip needs to decoil more slowly, since an elongation of the loop means that the rate at which the strip is fed exceeds the rate at which the strip is being utilized by the machine.

It is therefore important in light of the foregoing, that the length of the loop formed by the strip internally of the equalizing chamber must be detected quickly and precisely; in effect, errors or delays in reading the length of the loop can easily result in significant variations in the tension on the strip, causing the material to break or affecting the quality of its use by the machine.

Moreover, a system typically able to ensure optimum control of the decoil rate will utilize PID type algorithms, which ideally require an instantaneous and continuously generated reading of the reference quantity, in this instance the length of the loop formed by the strip inside the equalizing chamber.

In the case of conventional units for feeding a strip of sheet material to a user machine, however, sensors that produce a continuous output (such as optical or ultrasound types) are not normally used inasmuch as these guarantee a correct measurement only within a predetermined and limited range of variation in the length of the loop. If the length of the strip registers outside this predetermined range as a result of abnormal operating conditions (e.g. a sudden deceleration of the user machine), the reading supplied by the continuous output type of sensor will be false and therefore the control function governing the decoil rate, which is based on the reading, becomes unreliable.

The object of the present invention is to provide a method of feeding a strip that will be simple and economical, and will also allow a quick and precise reading of the length of the loop formed by the running strip within the equalizing chamber.

SUMMARY OF THE INVENTION

The stated object is realized according to the present invention in a method for feeding a strip of sheet material to a user device that comprises the steps of operating decoil means by which the strip is drawn from a roll located at a decoiling station, feeding the strip toward the user device across the mouth of a vacuum equalizing chamber, attracting the advancing strip into the equalizing chamber in such a way that it forms a loop, and maintaining a length of the loop within a selected range of variation determined by at least one first sensor located within the equalizing chamber and furnishing a binary output.

The essential feature of the method disclosed is that it comprises the further step of measuring the length of the loop within the selected range of variation by means of at least one second sensor located within the equalizing chamber and furnishing a continuous output, in such a way that the operation of the decoil means can be piloted to maintain the length of the loop substantially equal to a predetermined value.

The present invention also relates to a unit for feeding a strip of sheet material to a user device; such a unit comprises decoil means positioned at a decoiling station, by which the strip is drawn from a roll, a feed line positioned between the decoiling station and the user device, along which the strip is directed to the user device, also a vacuum type equalizing chamber positioned along the feed line by which a portion of the advancing strip is attracted and caused to form a loop extending into the chamber, and at least one first sensor furnishing a binary output, located within the chamber and serving to determine a selected range of variation applicable to a measured length of the loop.

In addition, the unit according to the invention comprises at least one second sensor located inside the vacuum equalizing chamber and furnishing a continuous output, by means of which to measure a length of the loop, and control means governing the operation of the decoil means in such a way as to maintain the length substantially equal to a predetermined value; also, the control means are connected to the first and second sensors in such a way as to maintain the length of the loop within the selected range of variation by means of the first sensor, and to measure the length of the loop within the selected range of variation by means of the second sensor.

BRIEF DESCRIPTION OF THE DRAWINGS

The invention will now be described in detail , by way of example, with the aid of the accompanying drawings, in which.

DESCRIPTION OF THE PREFERRED EMBODIMENTS

Figure 1:
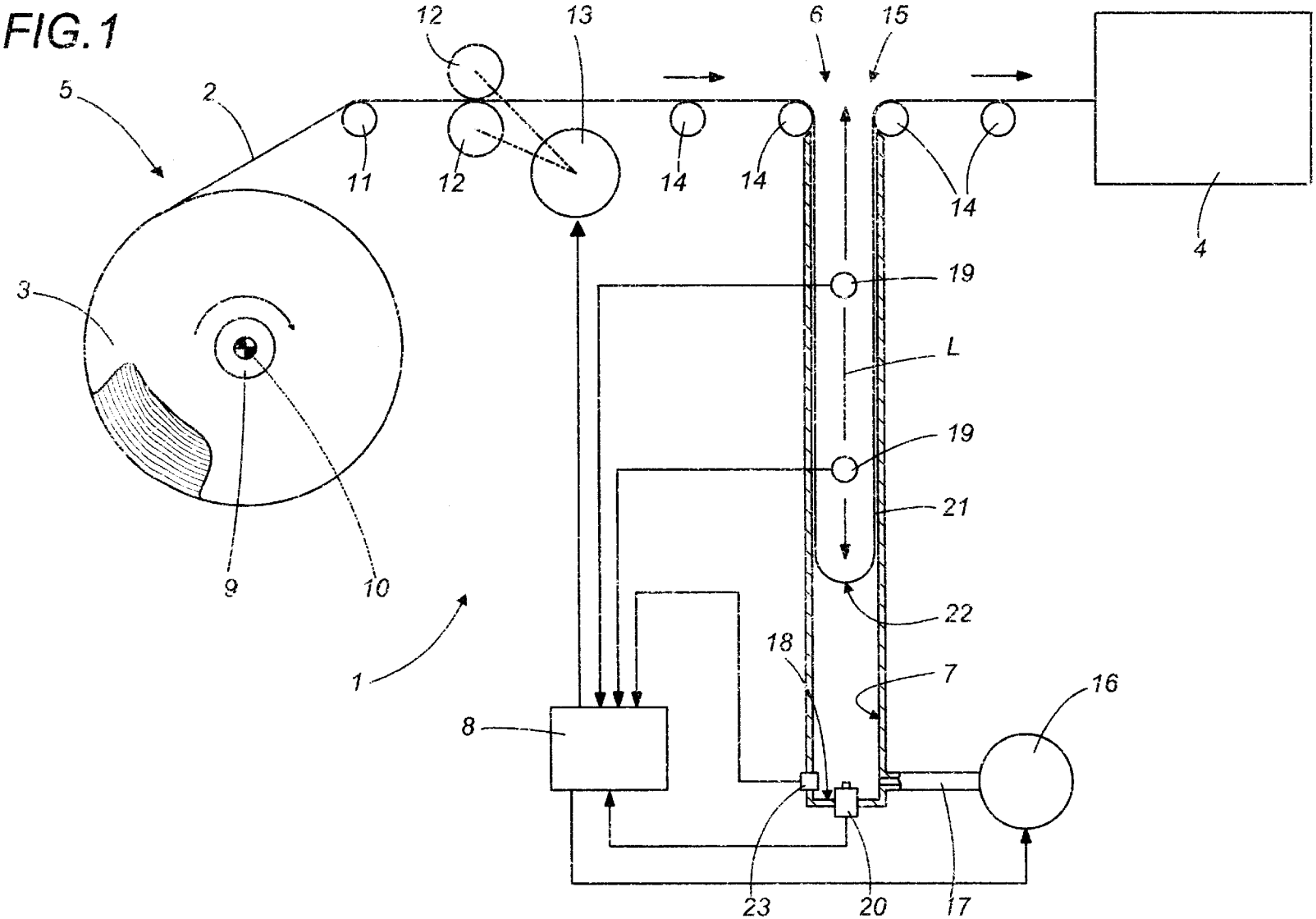
FIG. 1 shows a preferred embodiment of a unit for feeding a strip of sheet material, illustrated schematically and with certain parts omitted for clarity.
Figure 2:
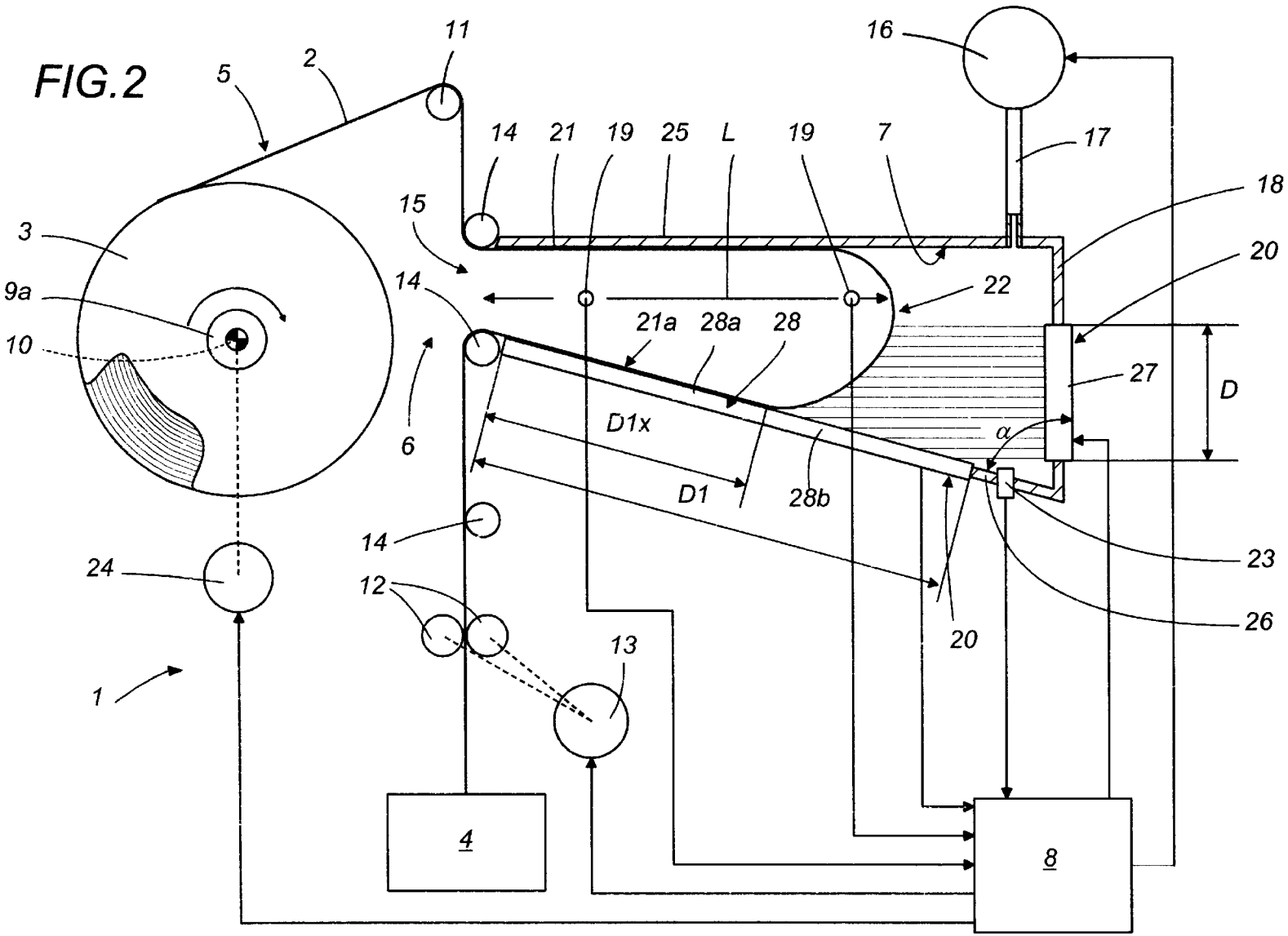
FIG. 2 shows a further embodiment of the feed unit in question, illustrated schematically and with certain parts omitted for clarity.

With reference to FIGS. 1 and 2 of the drawings, 1 denotes a unit, in its entirety, for feeding a strip 2 of sheet material, typically paper, which is decoiled from a roll 3 and directed toward a user device 4 consisting, for example, in a cigarette manufacturing or packaging machine.

Such a unit 1 comprises a decoiling station 5 (of conventional embodiment) at which the strip 2 is drawn from the roll 3, a feed line 6 (conventional likewise) located between the decoiling station 5 and the user device 4, along which the strip 2 is directed to this same device 4, an equalizing chamber 7 located along the feed line 6, and a control device 8.

Considering the example of FIG. 1, in particular, the decoiling station 5 incorporates a pivot 9 supporting the roll 3, rotatable about an axis 10 disposed perpendicular to the viewing plane of the drawing, a plurality of freely revolving pulleys 11 (one only of which is illustrated), and a pair of pinch rolls 12 (conventional in embodiment) coupled to drive means 13 of which the operation is piloted by the control device 8 in such a way as to ensure that the strip 2 will decoil from the roll 3 at a predetermined rate.

The feed line 6 comprises a plurality of freely revolving pulleys 14 including two positioned to coincide with the mouth 15 of the chamber 7, which appears elongated in shape and of constant section.

In both embodiments illustrated (FIGS. 1 and 2), the feed unit 1 further comprises a vacuum pump 16 connected to the control device 8 and caused to communicate with the chamber 7 by way of a duct 17 passing through the chamber wall substantially at the base 18, in such a way that a negative pressure of predetermined constant value can be generated internally of the chamber 7.

Reference number 19 denotes one of two pressure sensors furnishing a binary output, for example of the type disclosed in UK Patent A 1 469 683, positioned within the chamber 7 and designed to establish whether or not the pressure in the enclosure is negative in relation to that of the atmosphere.

In the example of FIG. 1, the unit also comprises a sensor 20 mounted to the base 18 of the chamber 7 and providing a continuous output, typically an ultrasound or optical device (a laser sensor or a CCTV camera, for instance), of which the function is to monitor the length L of a loop 21 described by the running strip 2 internally of the chamber 7. The length L in question will be read normally in indirect fashion, by measuring the distance between an extremity 22 of the loop 21 and the base 18 of the chamber 7.

The reading of the length L given by this second sensor 20 is guaranteed precise within a selected range of variation, delimited by the aforementioned two first sensors 19.

Also positioned internally of the chamber 7 is a pressure sensor 23 serving to monitor the effective value of the pressure within the enclosure. All the sensors 19, 20 and 23 are connected to the control device 8.

In the example of FIG. 2, the decoiling station 5 incorporates a pivot 9*a* supporting the roll 3, rotatable about an axis 10 perpendicular to the viewing plane, a plurality of freely revolving pulleys 11 (one only of which is illustrated), and a pair of pinch rolls 12 (conventional in embodiment) coupled to drive means 13 of which the operation is piloted by the control device 8 in such a way as to ensure that the strip 2 will decoil from the roll 3 at a predetermined rate. More exactly, the pivot 9*a* is connected to drive means 24 piloted by the control device 8 in such a manner that the roll 3 will be caused to rotate at a predetermined speed, proportional at any given moment to its own diameter, and the strip 2 thus made to decoil at a linear velocity identical to the velocity at which it is advanced by the pinch rolls 12 toward the user device 4, likewise at any given moment.

The feed line 6 comprises a plurality of freely revolving pulleys 14 including two positioned to coincide with the mouth 15 of the chamber 7, which in the embodiment of FIG. 2 exhibits an elongated and irregular longitudinal section, appearing substantially frustoconical, of which the lesser base coincides with the mouth 15 and the greater base coincides with the base 18 of the chamber.

As in the embodiment of FIG. 1, the unit 1 shown in FIG. 2 comprises two pressure sensors 19 located in the chamber 7, furnishing a binary output and serving to indicate whether or not the pressure in the enclosure is negative in relation to that of the atmosphere.

In the example of FIG. 2, the equalizing chamber 7 is disposed substantially horizontal and extends from the mouth 15 on the left (as viewed in the drawing) toward the base 18, which is substantially vertical in this instance, on the right. Viewed in longitudinal section, the chamber 7 is delimited bilaterally by a first substantially horizontal wall 25 uppermost, extending from the top end of the base 18 to the mouth 15, and a second wall 26 below, extending from the bottom end of the base 18 to the mouth 15. The second wall 26 of the chamber is angled inwards relative to the base 18, with which it forms an acute angle $\alpha$ of predetermined value.

Like the unit in FIG. 1, the unit of FIG. 2 is equipped with a sensor 20 furnishing a continuous output and serving to monitor the length L of a loop 21 described by the running strip 2 internally of the chamber 7. In this instance the sensor 20 comprises an emitter 27 of optical signals, laser for example, incorporated into the base 18 of the chamber and presenting a predetermined longitudinal dimension D, and a receiver/transducer 28 extending along the second wall 26 of which the function is to pick up and convert the optical signals from the emitter 27, presenting a predetermined longitudinal dimension D1 that is dictated by the corresponding dimension D of the emitter and the angle $\alpha$ between the base 18 and the wall 26.

As discernible from the illustration of FIG. 2, the receiver/transducer 28, being associated with the second wall 26, is inclined at the same angle $\alpha$ in relation to the emitter 27, which in its turn is disposed substantially vertically, being associated with the base 18. With this type of configuration, the receiver/transducer 28 is disposed transversely and at a predetermined angle $\alpha$ to the direction of the signals issuing from the emitter 27 and thus will be able, in the event that there is no strip 2 occupying the chamber 7, to pick up and convert all the signals generated by the emitter 27.

In the example of FIG. 2, during operation of the unit 1, the strip 2 is drawn into the chamber 7 and made to form a loop 21 of which a lower branch 21*a* is forced into contact with the second wall 26 of the chamber 7, and into contact with at least a portion 28*a* of the receiver/transducer 28, through the effect of the partial vacuum created by the pump 16; consequently, the signals generated by the emitter 27 are prevented from reaching this same portion 28*a* of the receiver/transducer 28 covered by the lower branch 21*a* of the loop 21. Thus, the signals generated by the emitter 27 strike only a given portion 28*b* of the receiver/transducer 28 not covered by the lower branch 21*a* of the loop 21, as indicated in FIG. 2, and the length L of the loop 21 will be arrived at typically in indirect manner, computing the difference between the length D1 of the receiver/transducer and the length D1*x* of the exposed portion 28*b* which, being unobscured, is struck by the signals from the emitter 27. Clearly enough, if the overall length D1 of the receiver/transducer 28 is known, then a computation of the difference between this same length D1 and the length D1*x* of the exposed portion 28*a*, performed by the control device 8, will give the length of the loop 21 occupying the chamber 7.

In operation, referring first to the embodiment of the unit 1 illustrated in FIG. 1, the strip 2 is drawn from the roll 3 by the pinch rolls 12 at a predetermined rate and fed toward the user device 4 by the feed line 6, passing through the chamber 7, in which a negative pressure of constant value is maintained by the vacuum pump 16. The operation of the pump 16 is interlocked to the control device 8 and piloted in response to a feedback signal from the sensor 23 indicating the effective value of the negative pressure in the chamber 7.

As a result of the strip 2 describing a loop 21 within the chamber 7, the enclosed space is divided into an upper portion in which pressure remains atmospheric, and a lower portion in which a partial vacuum is maintained by the pump 16. More exactly, the strip 2 becomes subject to a force of suction tending to draw the sheet material into the chamber 7, of which the value is equivalent to the difference between the pressure of the atmosphere and the negative pressure generated by the vacuum pump 16, multiplied by the cross sectional area of the chamber 7. Thus, the strip 2 is tensioned by a force equating to this same force of suction.

As long as the length L of the loop 21 is within the predetermined range of variation, the output signal from the second sensor 20 allows the control device 8 to monitor the value of the length L from one instant to the next in substantially continuous fashion and, on the basis of this same value, to control the rate at which the strip 2 is decoiled from the roll 3, piloting the operation of the drive means 13 in such a way as to maintain the length L of the loop substantially constant over time and equal to a selected value.

The operation of the unit illustrated in FIG. 2 is not substantially different to that illustrated in FIG. 1, and accordingly no further description is given.

It is worth stating nonetheless that the control device 8 will be programmed to pilot the operation of the drive means 24 coupled to the pivot 9*a* on which the roll 3 is rotated about its axis 10, and simultaneously set the pinch rolls 12 in rotation to decoil the strip 2 as the roll 3 is rotated by the pivot 9*a,* so that the strip 2 can be drawn off at a predetermined angular velocity and advanced along the line 6 toward the user device 4, passing through the chamber 7, in which a partial vacuum of steady value is maintained by the pump 16. In like manner to the example of FIG. 1, the vacuum pump 16 is connected through a feedback loop to the control device 8, which monitors the actual pressure in the chamber by way of the sensor 23. Observing FIG. 2, it will be seen that the formation of a loop 21 in the advancing strip 2 has the effect of dividing the chamber 7 into a left lateral portion in which pressure remains atmospheric, and a right lateral portion in which a partial vacuum is maintained by the pump 16. The strip 2 thus becomes subject to a force of suction internally of the chamber 7, and is tensioned by a force equating to this same force of suction.

The emitter 27 directs a continuous beam of laser signals toward the receiver/transducer 28, and a proportion of these signals will be intercepted by the loop 21 occupying the chamber 7. The signals not intercepted by the loop 21 fall on the exposed portion 28*b* of the receiver/transducer 28. The control device 8 computes the difference between the overall length D1 of the receiver/transducer 28 and the length D1*x* of the portion 28*a* obscured by the lower branch 21*a* of the loop 21, and is able to determine the length of the loop 21 occupying the chamber 7. If the length of the loop 21 is within the aforementioned range of variation, the control device 8 monitors the value of the length L in substantially continuous fashion and, on the basis of the current length L, pilots the drive means 24 controlling the rotational speed of the pivot 9*a,* also the drive means 13 of the pinch rolls 12 dictating the linear velocity at which the strip 2 is decoiled from the roll 3, in such a way as to maintain the length L substantially constant over time at a selected value.

It remains the case in either one of the two embodiments illustrated in FIGS. 1 and 2, that if the length L increases, i.e. if the quantity of strip 2 decoiled exceeds the quantity utilized by the downstream device 4, the rate will be lowered, whereas if the length L decreases, signifying that the quantity of strip decoiled is less than the quantity utilized, the rate will be raised.

Whenever the extremity 22 of the loop 21 shifts along the chamber 7 and passes across a pressure sensor 19, the sensor 19 is effectively displaced from one portion of the chamber 7 to the other, for example from the atmospheric upper portion to the evacuated lower portion, with the result that its output status changes (from 0 to 1 or viceversa).

The two first pressure sensors 19 thus provide means by which the control device 8 maintains the length L of the loop 21 within the selected range of variation, and in practice, within the part of the chamber 7 compassed by the two sensors 19.

In the event that either of the first pressure sensors 19 should change status as a result of the length L drifting outside the established range of variation, the control device 8 will temporarily ignore the reading given by the second sensor 20, as this is unreliable while the length L remains out of range, and seek to bring the length L back within range by piloting the appropriate correction via the drive means 13. For example, if the output of the uppermost sensor 19 changes as the result of an insufficient throughput of strip 2, the control device 8 will pilot an acceleration of the drive means 13 to bring the loop 21 back within the area compassed by the two sensors 19. Once the length L has been restored to a value within the selected range of variation, the normal configuration can be resumed, that is to say, with the drive means 13 interlocked by way of the control device 8 to the reading of the second sensor 20.

An alternative embodiment of the feed unit 1 (not illustrated) might comprise just one first pressure sensor 19, by which the selected range of variation of the length L is determined from a single point of reference above or below the loop.

In another possible embodiment (not illustrated), the feed unit 1 might comprise a pair of second sensors 20 utilized in alternation, i.e. with one in a backup role, or utilized together to give an averaged value from two readings of the length L.

In the feed unit 1 described and illustrated, at all events, the solution of monitoring the length L of the loop 21 inside the chamber 7 by means of a sensor 20 producing a continuous output (whether ultrasound or other optical type), is instrumental in obtaining a precise and substantially continuous reading, in real time.

The use of two pressure sensors 19 also ensures that the second sensor 20 will monitor the length L of the loop 21 only within a predetermined range of variation, internally of which this same sensor 20 operates in optimum conditions and guarantees a precise reading.

The feed unit according to the present invention thus combines key advantages deriving from the use of a sensor generating a continuous output, i.e. precision, speed and a continuous reading, with the advantages afforded by the pressure sensors, i.e. the capacity of the unit to function correctly in any operating conditions.

What is claimed is:

1. A method for feeding a strip of sheet material to a user device, comprising:

drawing the strip from a roll located at a decoiling station;

feeding the strip toward the user device across the mouth of a vacuum equalizing chamber;

attracting the advancing strip into the equalizing chamber such that it forms a loop;

maintaining a length of the loop within a selected range of variation determined by a first sensor located within the equalizing chamber and furnishing a binary output; and, measuring the length of the loop within the selected range of variation with a second sensor located within the equalizing chamber and furnishing a continuous output, such that the drawing maintains the length of the loop substantially equal to a predetermined value.

2. A method as in claim 1, wherein the selected range of variation is established by a pair of first sensors located within the equalizing chamber and furnishing a binary output.

3. A method as in claim 1, wherein the first sensor is a pressure sensor furnishing a binary output.

4. A method as in claim 1, wherein the second sensor is an ultrasound device.

5. A method as in claim 1, wherein the second sensor is an optical device.

6. A method for feeding a strip of sheet material to a user device, comprising:

drawing the strip from a roll located at a decoiling station;

feeding the strip toward the user device across the mouth of a vacuum equalizing chamber;

attracting the advancing strip into the equalizing chamber such that it forms a loop;

maintaining a length of the loop within a selected range of variation determined by a first sensor located within the equalizing chamber and furnishing a binary output; and, measuring the length of the loop within the selected range of variation with a second sensor located within the equalizing chamber and furnishing a continuous output, in such that the drawing maintains the length of the loop substantially equal to a predetermined value;

wherein the second sensor comprises:

an emitter of signals disposed on a side of at least one branch formed in the loop described by the strip within the chamber;

a receiver/transducer which receives the signals originating from the emitter, disposed on an opposite side of the branch from the emitter such that the optical signals originating from the emitter are partially blocked by the strip and strike only a portion of the receiver/transducer not obscured by the branch of the loop.

7. A unit for feeding a strip of sheet material to a user device, comprising:

a decoiler, positioned at a decoiling station, constructed and arranged to draw the strip from a roll;

a feed line positioned between the decoiling station and the user device, along which the strip is directed to the user device;

a vacuum type equalizing chamber positioned along the feed line, constructed and arranged to attract a portion of the advancing strip and to cause the portion to form a loop extending into the chamber;

a first sensor furnishing a binary output, located within the vacuum equalizing chamber and constructed and arranged to determine a selected range of variation applicable to a measured length of the loop;

a second sensor located within the vacuum equalizing chamber and constructed and arranged to furnish a continuous output to measure a length of the loop; and a controller to govern the operation of the decoiler so as to maintain the length of the loop substantially equal to a predetermined value, wherein the controller is connected to the first and second sensors so as to maintain the length of the loop within the selected range of variation by means of the first sensor and to measure the length of the loop within the selected range of variation by means of the second sensor.

8. A unit as in claim 7, comprising a pair of first sensors furnishing a binary output, located within the equalizing chamber and serving to establish the selected range of variation.

9. A unit as in claim 7, wherein the first sensor is a pressure sensor furnishing a binary output.

10. A unit as in claim 7, wherein the second sensor is an ultrasound device.

11. A unit as in claim 7, wherein the second sensor is an optical device.

12. A unit for feeding a strip of sheet material to a user device, comprising:

a decoiler positioned at a decoiling station, by which the strip is drawn from a roll;

a feed line positioned between the decoiling station and the user device, along which the strip is directed to the user device;

a vacuum type equalizing chamber positioned along the feed line, constructed and arranged to attract a portion of the advancing strip and to cause the portion to form a loop extending into the chamber;

a first sensor furnishing a binary output, located within the vacuum equalizing chamber and constructed and arranged to determine a selected range of variation applicable to a measured length of the loop;

a second sensor located within the vacuum equalizing chamber and constructed and arranged to furnish a continuous output to measure a length of the loop; and a controller to govern the operation of the decoiler so as to maintain the length of the loop substantially equal to a predetermined value, wherein the controller is connected to the first and second sensors so as to maintain the length of the loop within the selected range of variation by means of the first sensor and to measure the length of the loop within the selected range of variation by means of the second sensor;

an emitter of signals disposed on a side of at least one branch formed in the loop described by the strip within the chamber;

a receiver/transducer which receives the signals originating from the emitter, disposed on an opposite side of the branch from the emitter such that the optical signals originating from the emitter are partially blocked by the strip and strike only a portion of the receiver/transducer not obscured by the branch of the loop.

* * * * *